US010229641B2

(12) United States Patent
Yang et al.

(10) Patent No.: US 10,229,641 B2
(45) Date of Patent: Mar. 12, 2019

(54) DRIVING METHOD OF ELECTROPHORETIC DISPLAY

(71) Applicant: E Ink Holdings Inc., Hsinchu (TW)

(72) Inventors: Bo-Ru Yang, New Taipei (TW); Ping-Yueh Cheng, Taoyuan (TW); Chi-Mao Hung, Taoyuan (TW); Chun-An Wei, New Taipei (TW); Yao-Jen Hsieh, Taoyuan (TW)

(73) Assignee: E Ink Holdings Inc., Hsinchu (TW)

( * ) Notice: Subject to any disclaimer, the term of this patent is extended or adjusted under 35 U.S.C. 154(b) by 22 days.

(21) Appl. No.: 14/957,625

(22) Filed: Dec. 3, 2015

(65) Prior Publication Data

US 2016/0093253 A1 Mar. 31, 2016

Related U.S. Application Data

(62) Division of application No. 13/042,467, filed on Mar. 8, 2011, now abandoned.

(30) Foreign Application Priority Data

Mar. 12, 2010 (TW) ..... 99107305 A

(51) Int. Cl.
*G09G 3/34* (2006.01)

(52) U.S. Cl.
CPC ..... *G09G 3/344* (2013.01); *G09G 2310/068* (2013.01)

(58) Field of Classification Search
CPC ..... G09G 3/344; G09G 2310/061; G09G 2310/068; G09G 2310/0245; G02F 1/167; G02F 2001/1678
See application file for complete search history.

(56) References Cited

U.S. PATENT DOCUMENTS

| | | | | |
|---|---|---|---|---|
| 8,243,013 | B1 * | 8/2012 | Sprague | G09G 3/344 345/107 |
| 2005/0001812 | A1 * | 1/2005 | Amundson | G02F 1/167 345/107 |
| 2006/0038772 | A1 * | 2/2006 | Amundson | G02F 1/167 345/107 |
| 2006/0202948 | A1 * | 9/2006 | Johnson | G09G 3/2011 345/107 |
| 2006/0232548 | A1 * | 10/2006 | Johnson | G09G 3/344 345/107 |
| 2007/0018944 | A1 * | 1/2007 | Johnson | G09G 3/344 345/107 |

(Continued)

*Primary Examiner* — Patrick Edouard
*Assistant Examiner* — Eboni Hughes
(74) *Attorney, Agent, or Firm* — JCIPRNET

(57) ABSTRACT

A driving method of an electrophoretic display having at least one display particle is provided. The driving method includes the following steps. A first voltage difference is applied to a data line in a first period, in which the data line corresponds to one of the display particles. At least one particle restore period is inserted in the first period, and a second voltage difference is applied to the data line in the particle restore periods, in which the second voltage difference is different from the first voltage difference. With this method disclosed here, the maxima brightness, maxima darkness, contrast ratio, color saturation, bistability, and image updating time can be largely improved.

5 Claims, 8 Drawing Sheets

(56) References Cited

U.S. PATENT DOCUMENTS

| | | | | |
|---|---|---|---|---|
| 2007/0070028 | A1* | 3/2007 | Zhou | G09G 3/344 345/107 |
| 2007/0080926 | A1* | 4/2007 | Zhou | G09G 3/344 345/107 |
| 2007/0080927 | A1* | 4/2007 | Zhou | G09G 3/344 345/107 |
| 2007/0103427 | A1* | 5/2007 | Zhou | G09G 3/344 345/107 |
| 2007/0212022 | A1* | 9/2007 | Zhou | G09G 3/344 386/344 |
| 2007/0247417 | A1* | 10/2007 | Miyazaki | G09G 3/344 345/107 |
| 2008/0094315 | A1* | 4/2008 | Johnson | G09G 3/344 345/58 |
| 2008/0224989 | A1* | 9/2008 | Zhou | G09G 3/344 345/107 |
| 2008/0266243 | A1* | 10/2008 | Johnson | G09G 3/344 345/107 |
| 2009/0237351 | A1* | 9/2009 | Kanamori | G02F 1/167 345/107 |
| 2011/0057871 | A1* | 3/2011 | Miyashita | G09G 3/344 345/107 |
| 2011/0134162 | A1* | 6/2011 | Yamazaki | G09G 3/344 345/690 |
| 2011/0221740 | A1* | 9/2011 | Yang | G09G 3/344 345/214 |

* cited by examiner

DRIVING METHOD OF ELECTROPHORETIC DISPLAY

CROSS-REFERENCE TO RELATED APPLICATION

This is a divisional application of and claims the priority benefit of U.S. application Ser. No. 13/042,467, filed on Mar. 8, 2011. The prior application Ser. No. 13/042,467 claims the priority benefit of Taiwan application serial no. 99107305, filed Mar. 12, 2010. The entirety of the above-mentioned patent application is hereby incorporated by reference herein and made a part of this specification.

BACKGROUND OF THE INVENTION

Field of the Invention

The invention relates generally to a driving method of a display, and more particularly, to a driving method of an electrophoretic display capable of enhancing the color saturation, brightness, contrast ratio, and image updating time of a displayed image.

Description of Related Art

In recent years, as display technologies are pursued vigorously, devices such as the electrophoretic display, the liquid crystal display, the plasma display, and the organic light emitting diode display have been commercialized and applied in display apparatuses of various size and shape. With the popularization of portable electronic devices, flexible displays (e.g., e-paper and e-book) have received market attention. Typically speaking, e-papers and e-books adopt electrophoretic display technologies for displaying an image. Taking the e-book for example, a sub-pixel therein is mainly formed by different colors (e.g., red, green, blue) of electrophoretic mediums and white charged particles mixed in the electrophoretic mediums. The white charged particles are manipulated by external driving, such that each pixel respectively displays black, white, red, green, blue, or colors adjusted at different levels.

Generally speaking, a conventional driving method of the electrophoretic display divides the writing duration into at least four periods: a pre-charge period, a gray-level write period, a reset period, and a frame follow period. Moreover, in different periods, corresponding voltages are applied to a data line and a common electrode of the electrophoretic display, so as to generate voltage differences in the data line and the common electrode to drive the display particles. In the pre-charge period, a positive voltage difference or a negative voltage difference is formed between the data line and the common electrode in order to increase the charge of the display particles (e.g., black, white, or other colors). In the gray-level write period, positive or negative voltage difference is formed between the data line and the common electrode according to the polarity of the display particles, so that display particles gradually appear visible. Moreover, the visibility of the display particles is proportional to an apply time of the aforesaid voltage difference. Accordingly, a gray-level distribution in a particular color field (e.g., a white image or a black image) is adjusted. In the reset period, the positive or negative voltage difference is formed between the data line and the common electrode, so that display particles emerge or immerse towards the boundaries to clear away afterimages. In the frame follow period, zero voltage difference is formed between the data line and the common electrode so that the display particles maintain their current positions.

SUMMARY OF THE INVENTION

An aspect of the invention provides an electrophoretic display capable of enhancing the color saturation, brightness, contrast ratio, image updating rate, and bistability of a displayed image.

An aspect of the invention provides an electrophoretic display capable of reducing the sudden decreasing of optical intensity upon removing the driving voltage.

An aspect of the invention provides an electrophoretic display capable of improving the particle packing density.

An aspect of the invention provides a driving method of an electrophoretic display having at least one display particle. The driving method of the electrophoretic display includes the steps described hereafter. In a first period, a first voltage difference is applied to a data line, in which the data line corresponds to one of the display particles. At least one particle restore period is inserted in the first period, and a second voltage difference is respectively applied to the data line in the particle restore periods, in which the second voltage difference is not the same as the first voltage difference. Generally, the second voltage would be lower than the first voltage.

According to an embodiment of the invention, the color particles may be positively or negatively charged, and the medium may be colored or transparent.

According to an embodiment of the invention, the aforesaid first and second voltage differences are formed between the data line and a common electrode of the electrophoretic display.

According to an embodiment of the invention, when more than one particle restore periods are inserted, a portion of the second voltage differences respectively applied to the data line in the particle restore periods is different from each other.

According to an embodiment of the invention, when more than one particle restore periods are inserted, the second voltage differences respectively applied to the data line in the particle restore periods are different from each other.

According to an embodiment of the invention, when more than one particle restore periods are inserted, the second voltage differences respectively applied to the data line in the particle restore periods are the same.

An aspect of the invention provides a driving method of an electrophoretic display having at least one display particle. The driving method of the electrophoretic display includes the steps described hereafter. In a first period, a first voltage is applied to a data line, and a second voltage is applied to a common electrode of the electrophoretic display, in which the data line corresponds to one of the display particles. At least one particle restore period is inserted in the first period, and a third voltage is respectively applied to the data line in the particle restore periods, in which the third voltage is not the same as the first voltage.

According to an embodiment of the invention, when more than one particle restore periods are inserted, a portion of or all of the third voltages respectively applied to the data line in the particle restore periods is different from each other. Or, the third voltages respectively applied to the data line in the particle restore periods are different from each other.

According to an embodiment of the invention, the aforesaid first period is a pre-charge period, a gray-level write period, or a reset period.

According to an embodiment of the invention, when more than one particle restore periods are inserted, the particle restore periods are adjacent or not adjacent to each other. Or, the particle restore periods are adjacent to each other in sequence.

According to an embodiment of the invention, when more than one particle restore periods are inserted, the cycles of the particle restore periods are different from each other. Or, a portion of or all of the cycles of the particle restore periods is the same.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Generally speaking, an electrophoretic display has a plurality of pixels, and an electrophoretic medium and white display particles are respectively disposed in the pixels. Moreover, the electrophoretic medium may be single-colored (e.g., black, white, or other colors) or a multi-color mixture. To facilitate description, a data line used for adjusting a gray-level distribution of a white image is referred to as a white data line, and a data line used for adjusting a gray-level distribution of a black image is referred to as a black data line. Additionally, since a pixel array in the electrophoretic display may be arranged in a variety of manners, the white data line and the black data line may be a same data line or different data lines, and embodiments of the invention should not be construed as limited thereto. Moreover, a common electrode may be disposed on a transparent substrate of a display region surface in the electrophoretic display, and the white and black data lines may be disposed on an array substrate of the electrophoretic display that is configured to control how each of the pixels is displayed. In the description hereafter, driving waveforms are used to describe a driving method of the white display particles in a black fluid. But the actual cases of applying this invention are not limited in only white particle in the black fluid. The driving method of display particles having other colors may be deduced from the following description as well.

First Embodiment

Figure 1A:
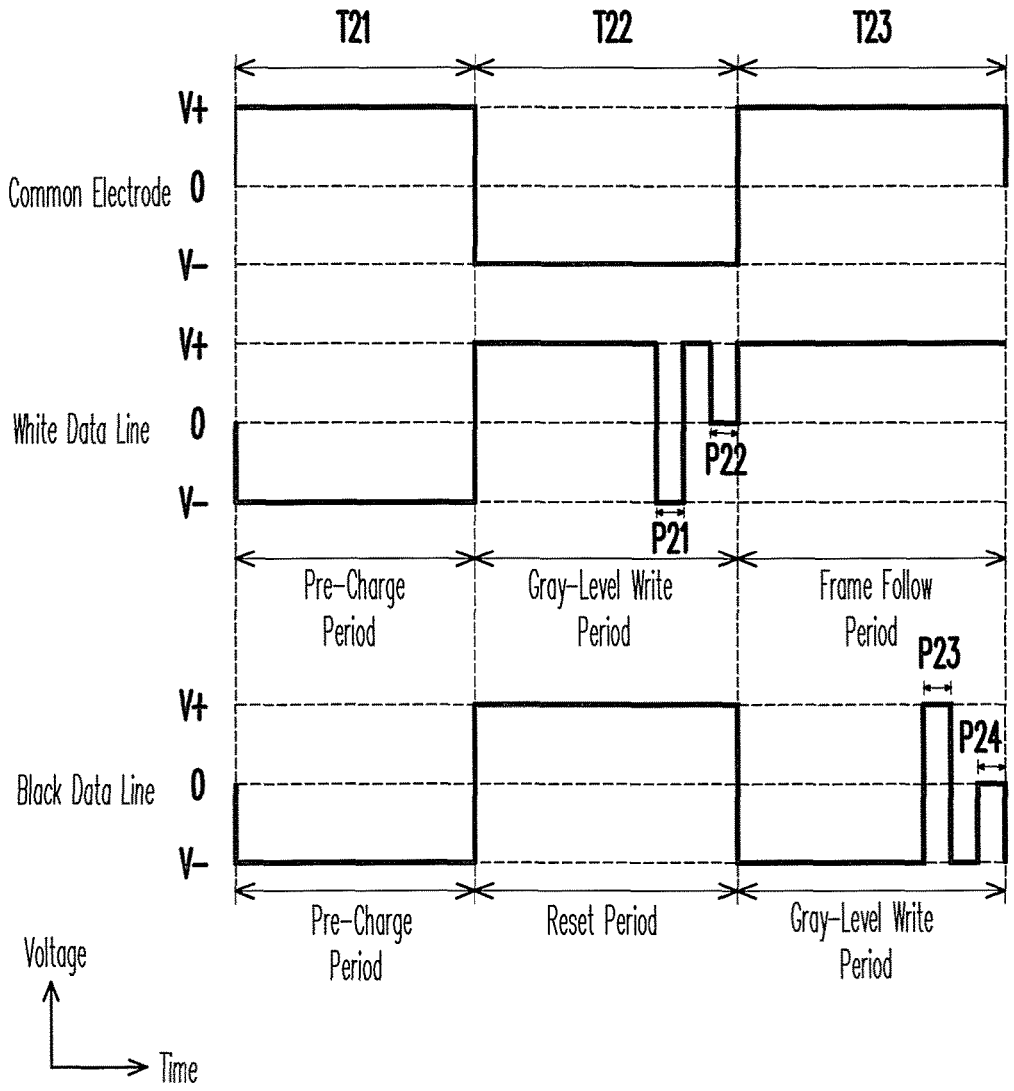
FIG. 1A is a schematic view illustrating a driving waveform of an electrophoretic display in accordance with a first embodiment of the invention.

FIG. 1A is a schematic view illustrating a driving waveform of an electrophoretic display in accordance with a first embodiment of the invention. Referring to FIG. 1A, in the present embodiment, assume a frame write period is formed by a period T21, a period T22, and a period T23, the display particles are white and positively charged, and the electrophoretic medium is black. However, other embodiments of the invention should not be construed as limited thereto. In the period T21, the electrophoretic display applies a positive voltage V+ to a common electrode and applies a negative voltage V− to a white data line and a black data line. The positive voltage V+ and the negative voltage V− may have a same voltage value. For instance, the positive voltage V+ can be +15 V and the negative voltage V− is −15 V, although embodiments of the invention should not be construed as limited thereto. At this moment, the white data line and the common electrode faun a negative voltage difference (i.e., same as applying a negative voltage difference to the white data line), and accordingly the particles are activated in this period. Therefore, the period T21 may be viewed as a pre-charge period for the white display particles. Moreover, the black data line and the common electrode also form a negative voltage difference (i.e., same as applying a negative voltage difference to the black data line), and similarly a charge carried by the white display particles is increased. The period T21 may therefore be viewed as the pre-charge period for the white display particles.

In the period T22, the electrophoretic display applies the negative voltage V− to the common electrode and applies the positive voltage V+ to the white data line and the black data line. At this moment, the white data line and the common electrode fo in a positive voltage difference (i.e., same as applying a positive voltage difference to the white data line), and accordingly the positively charged white display particles move towards the common electrode, so that the white display particles appear visible in the electrophoretic medium. A degree of visibility of the white display particles is directly proportional to a forming time of the positive voltage difference formed by the white data line and the common electrode. Since the electrophoretic display may display a gray level of a white image according to the visibility of the white display particles, the period T22 can be viewed as a gray-level write period of the white image. Moreover, the black data line and the common electrode also form a positive voltage difference (i.e., same as applying a positive voltage difference to the black data line), but since the white display particles are positively charged, the white display particles move towards the common electrode, so that the white display particles appear visible in the electrophoretic medium. Since an image clearing effect is achieved for a black image when the white display particles are completely visible, the period T22 can be viewed as a reset period of the black image.

Referring to FIG. 1A, in the present embodiment, particle restore periods P21 and P22 are inserted in the gray-level write period of the white image, in which the particle restore periods P21 and P22 are not adjacent to each other in timing. Moreover, voltages applied to the white data line in the particle restore periods P21 and P22 are different from each other, and these voltages are not the same as the positive voltage V+ used for writing the gray level. Furthermore, in the particle restore period P21, the voltage applied to the white data line is the negative voltage V−, and in the particle restore period P22, the voltage applied to the white data line is approximately 0 V. In other words, in the particle restore period P21, a voltage difference formed by the white data line and the common electrode (i.e., same as the voltage difference applied to the white data line) is the zero voltage difference.

In the particle restore period P22, a voltage difference form by the white data line and the common electrode (i.e., same as the voltage difference applied to the white data line) is approximately equal to the positive voltage V+, but still smaller than a voltage difference 2V+ (i.e., V+ subtracted by V−) used for writing the gray level. By lowering particles motion speed while approaching the boundaries of the device, the optical reflectance of the EPD device can be more stable. Therefore, the white display particles may closely approach the transparent substrate, thereby enhancing a reflected light by the white display particles to a maximum, and therefore the whiteness and contrast ratio of the electrophoretic displayed image may be increased. Besides, because the particle packing is more stable, the bistability can be increased.

In the period T23, the electrophoretic display applies the positive voltage V+ to the common electrode and the white data line, and applies the negative voltage V− to the black data line. At this moment, the white data line and the common electrode form a zero voltage difference (i.e., same as applying a zero voltage difference to the white data line), so that the white display particles do not move, and a gray-level distribution of the white image displayed by the electrophoretic display is maintained. Therefore, the period T21 can be viewed as a frame follow period of the white image. Moreover, the black data line and the common electrode faun a negative voltage difference (i.e., same as applying a negative voltage difference to the black data line), and the white display particles move towards black data line, so that the white display particles are gradually immersed in the electrophoretic medium. A degree of immersion of the white display particles is directly proportional to a forming time of the negative voltage difference formed by the black data line and the common electrode. Since the electrophoretic display may display a gray level of a black image according to the immersion degree of the white display particles, the period T23 can be viewed as a gray-level write period of the black image.

As shown in FIG. 1A, in the present embodiment, particle restore periods P23 and P24 are inserted in the gray-level write period of the black image. Moreover, the particle restore periods P23 and P24 are not adjacent to each other in timing, and the voltage differences formed by the black data line and the common electrode in the particle restore periods P23 and P24 are not the same. Additionally, in the particle restore periods P23 and P24, a voltage difference formed by the black data line and the common electrode is smaller than the voltage difference 2V+ (i.e., V+ subtracted by V−) used for writing the gray level. Therefore, the movement speed of the white display particles is likewise slowed. By lowering particles motion speed while approaching the boundaries of the device, the optical reflectance of the EPD device can be more stable. Accordingly, the white display particles may closely approach the array substrate, thereby decreasing a reflected light by the white display particles to a minimum, and therefore the blackness and the contrast ratio of the electrophoretic displayed image may be increased.

Figure 1B:
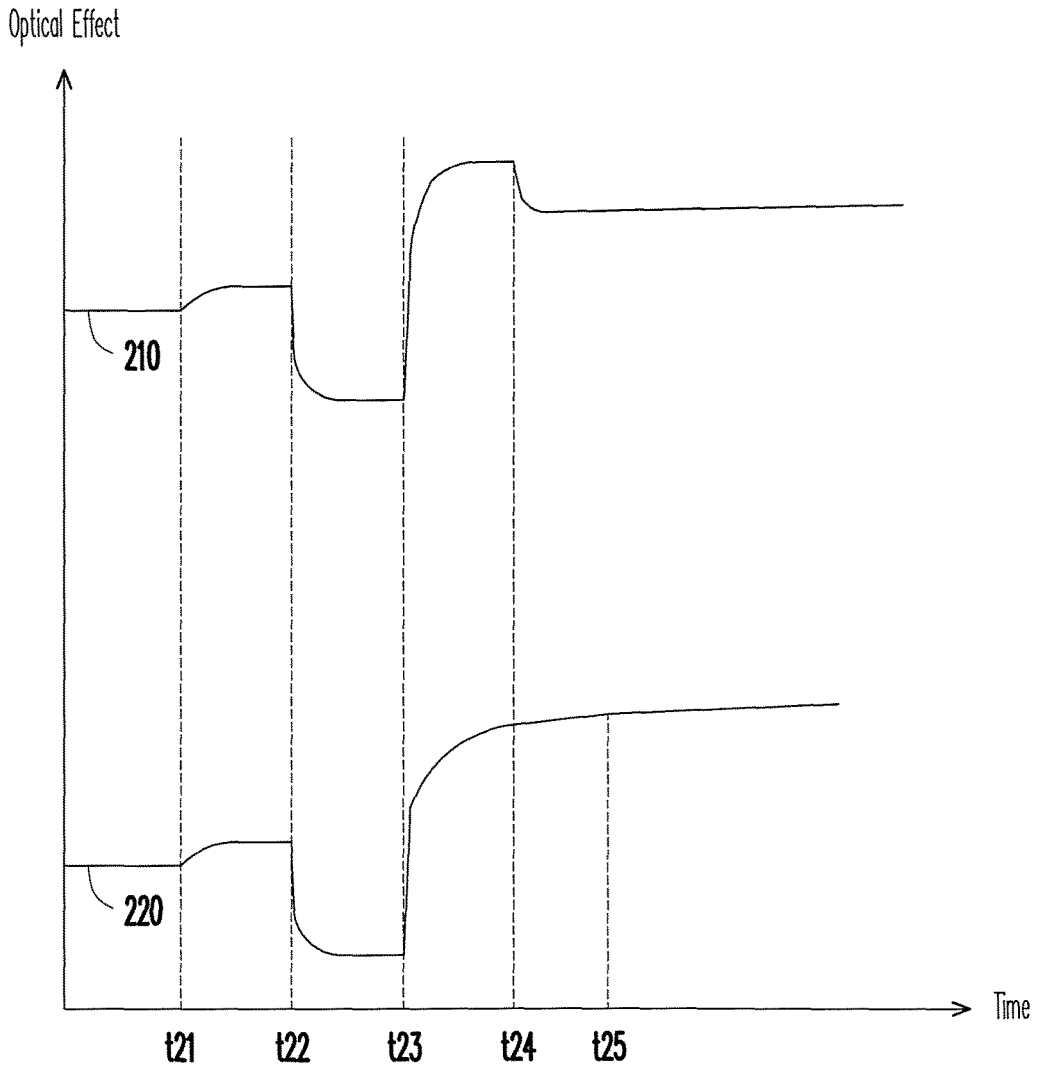
FIG. 1B is a schematic view illustrating optical tracks of the display particles.

Next, in the description hereafter, a driving method of a conventional electrophoretic display is compared with a driving method of the electrophoretic display according to an embodiment of the invention. FIG. 1B is a schematic view illustrating optical tracks of the display particles. Referring to FIG. 1B, a curve 210 is an optical track of the white display particles before the insertion of the particle restore periods in FIG. 1A, and a curve 220 is an optical track of the white display particles depicted in FIG. 1A. Time t21 to time t22 represents the period of T21, and time t22 to time t23 represents the period of T22. Moreover, time t23 to time 24 represents the period of T23 depicted in FIG. 1A. As shown in FIG. 1B, after the insertion of the particle restore periods in FIG. 1A, the bouncing back of optical intensity after removing the voltage at t24 is largely decreased. Therefore, the performances (whiteness, darkness, contrast ratio, image updating time, and bistability) of the display particles may be enhanced.

Figure 1C:
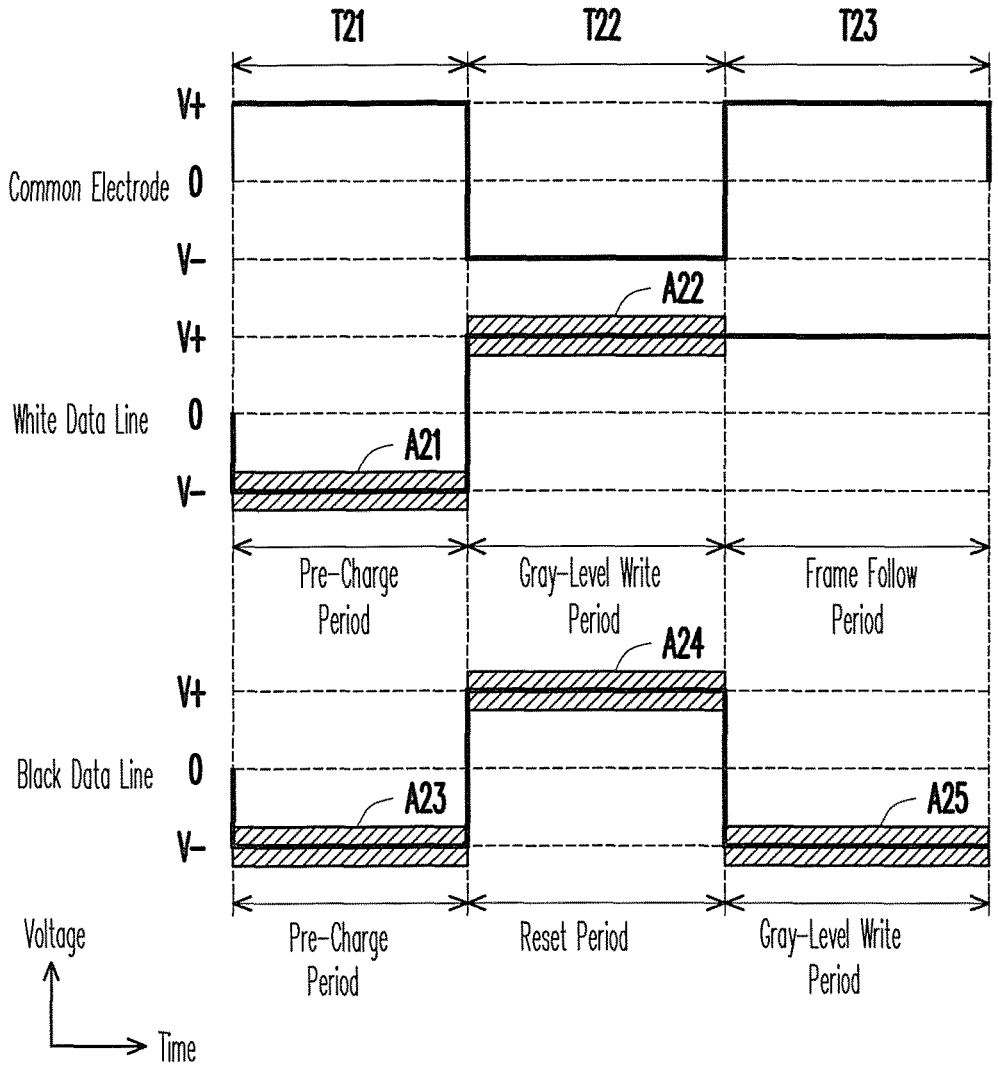
FIG. 1C is a schematic configuration view of the particle restore periods depicted in FIG. 1A.

It should be noted that, in the present embodiment, two particle restore periods are inserted for each gray-level write period. In other embodiments of the invention, there may be one, two, three, or more than three particle restore periods inserted in each gray-level write period, in which the adjustment may be made according to a display design. Moreover, the insertion time for each of the particle restore periods may likewise be different according to a design demand. Referring to FIG. 1C, besides being inserted in regionsA22 and A25 (e.g., the gray-level write periods of the white and black images), the particle restore periods may be respectively or concurrently inserted in regions A21, A23, and A24, or between these region s(e.g., the pre-charge period, or the reset period of the black image). More specifically, the particle restore periods may be inserted in a part of or all of the regions A21-A25. According to the voltage differences corresponding to the periods of insertion (e.g., regions A21-A25), the voltage differences formed in the particle restore periods are adjusted, such that the display particles closely approach the substrate (e.g., the transparent substrate or the array substrate).

Figure 1D:
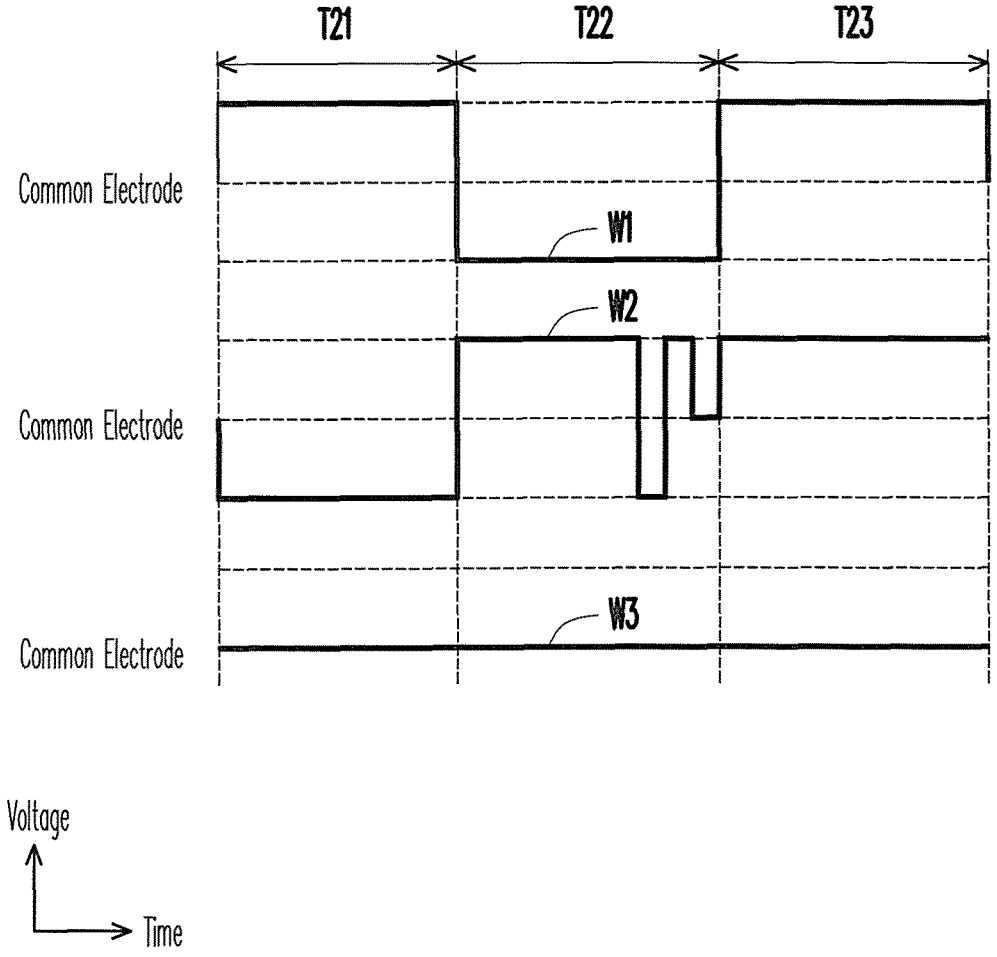
FIG. 1D is a schematic view illustrating a plurality of driving waveforms of the common electrode depicted in FIG. 1A.

Although the particle restore periods P21 and P22 depicted in FIG. 1A have a same cycle, in other embodiments of the invention, the cycles of the particle restore periods P21 and P22 may be different from each other, and a distance between the particle restore periods P21 and P22 may be adjusted according to a design demand. Moreover, although the voltage differences framed by the white data line and the common electrode in the particle restore periods depicted in FIG. 1A are different from each other, in other embodiments of the invention, the voltage differences formed by the white data line and the common electrode in the particle restore periods P21 and P22 may be designed to be the same. Referring to FIG. 1D, a voltage applied to the common electrode according to the present embodiment is depicted by a curve W1 (e.g., a square wave). However, in other embodiments of the invention, the voltage applied to the common electrode may be depicted as a curve W2 or a curve W3. That is, the voltage applied to the common electrode may have a direct current shape or other shapes, and embodiments of the invention should not be construed as limited thereto.

Second Embodiment

Figure 2:
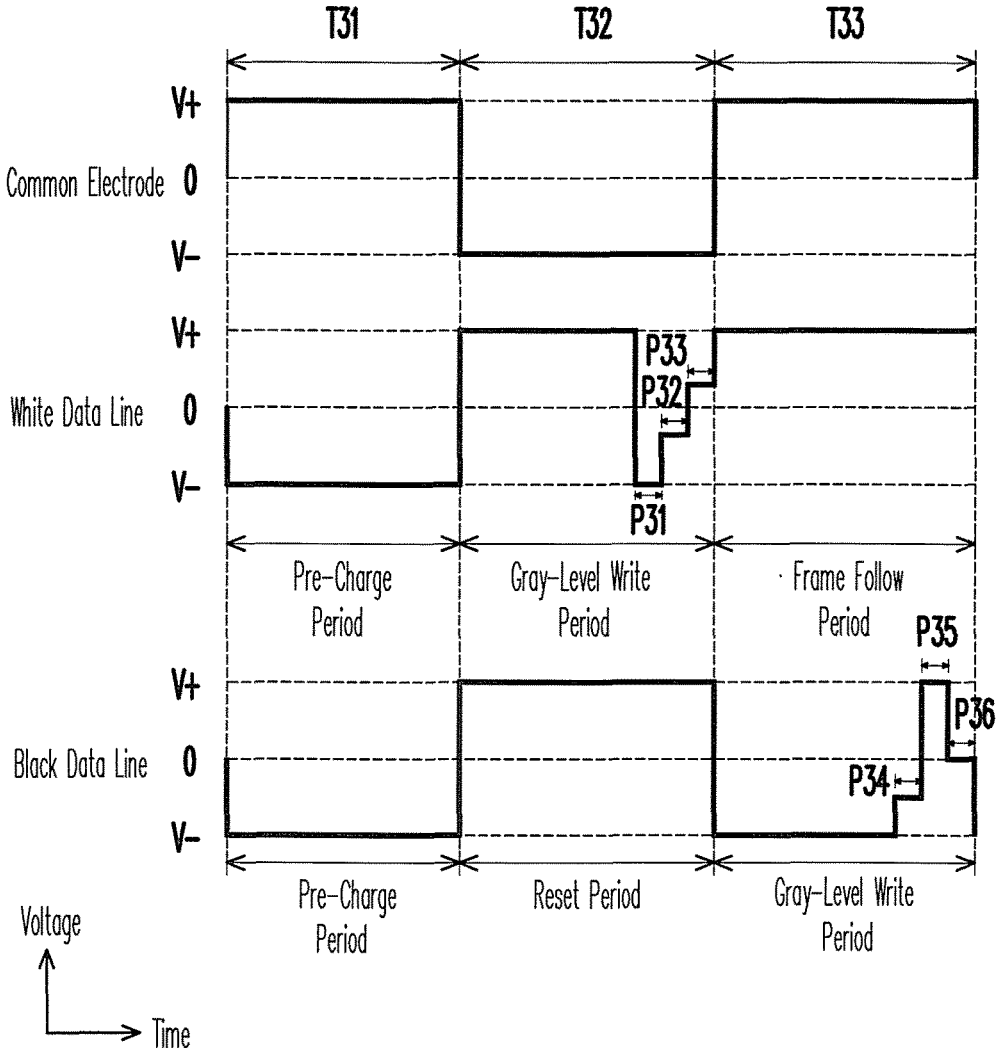
FIG. 2 is a schematic view illustrating a driving waveform of an electrophoretic display in accordance with a second embodiment of the invention.

FIG. 2 is a schematic view illustrating a driving waveform of an electrophoretic display in accordance with a second embodiment of the invention. Referring to FIG. 1A and FIG. 2, a difference resides in the particle restore periods P31, P32, P33, P34, P35, and P36. With regards to the white data line, the particle restore periods P31, P32, and P33 are adjacent in sequence, and the voltage differences formed by the white data line and the common electrode in the particle restore periods P31, P32, and P33 are progressively increased, in which the progressive increase begins from the zero voltage difference. With regards to the black data line, the particle restore periods P34, P35, and P36 are adjacent in sequence, and the voltage differences formed by the black data line and the common electrode in the particle restore periods P34, P35, and P36 are different from each other.

Third Embodiment

Figure 3:
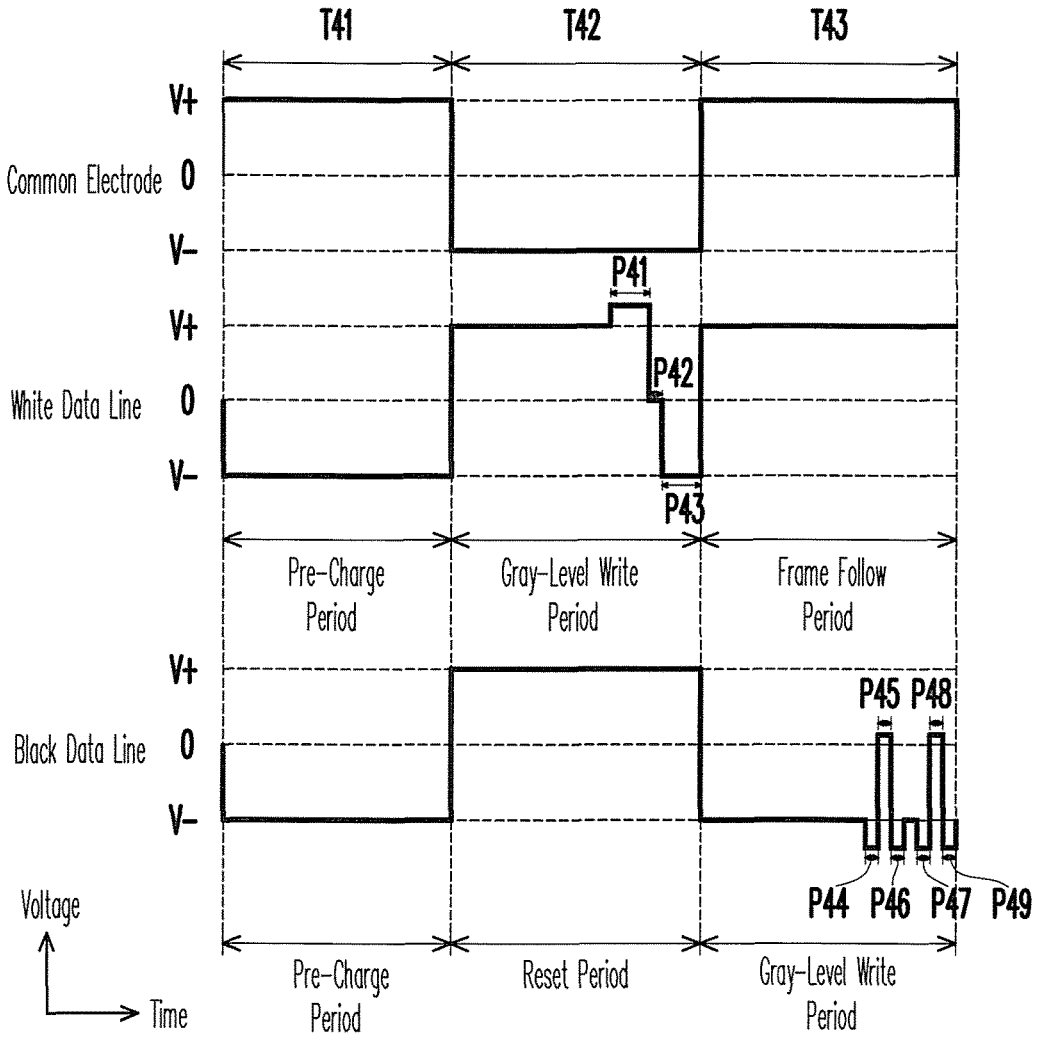
FIG. 3 is a schematic view illustrating a driving wavefoiin of an electrophoretic display in accordance with a third embodiment of the invention.

FIG. 3 is a schematic view illustrating a driving waveform of an electrophoretic display in accordance with a third embodiment of the invention. Referring to FIG. 1A and FIG. 3, a difference resides in the particle restore periods P41, P42, P43, P44, P45, P46, P47, P48, and P49. With regards to the white data line, the particle restore periods P41, P42, and P43 are adjacent in sequence, and the cycles of the particle restore periods P41, P42, and P43 are different from each other. Moreover, the voltage differences formed by the white data line and the common electrode in the particle restore periods P41, P42, and P43 are progressively decreasing, and the voltage difference formed by the white data line and the common electrode in the particle restore periods P41 is larger than the voltage difference 2V+ used for writing the gray level of the white image. However, in the particle restore period P41, a larger voltage difference does not quicken the movement of the white display particles. Instead, the movement speed of the electric double layer around the white display particles is increased, such that the electric double layer around the white display particles can envelop the white display particles.

With regards to the black data line, the particle restore periods P44, P45, and P46 are adjacent in sequence, and the particle restore periods P47, P48, and P49 are adjacent in sequence. Moreover, the particle restore periods P44, P45, and P46 are not adjacent to the particle restore periods P47, P48, and P49. The voltage differences formed by the black data line and the common electrode in the particle restore periods P45 and P48 are the same, and the voltage differences formed by the black data line and the common electrode in the particle restore periods P44, P46, P47, and P48 are the same. Moreover, the voltage differences formed in the particle restore periods P45 and P48 are not the same as the voltage differences fo Hied in the particle restore periods P44, P46, P47, and P48. As shown in FIG. 3, a voltage-alternating frequency of the white data line and the black data line may be different from each other.

Fourth Embodiment

Figure 4:
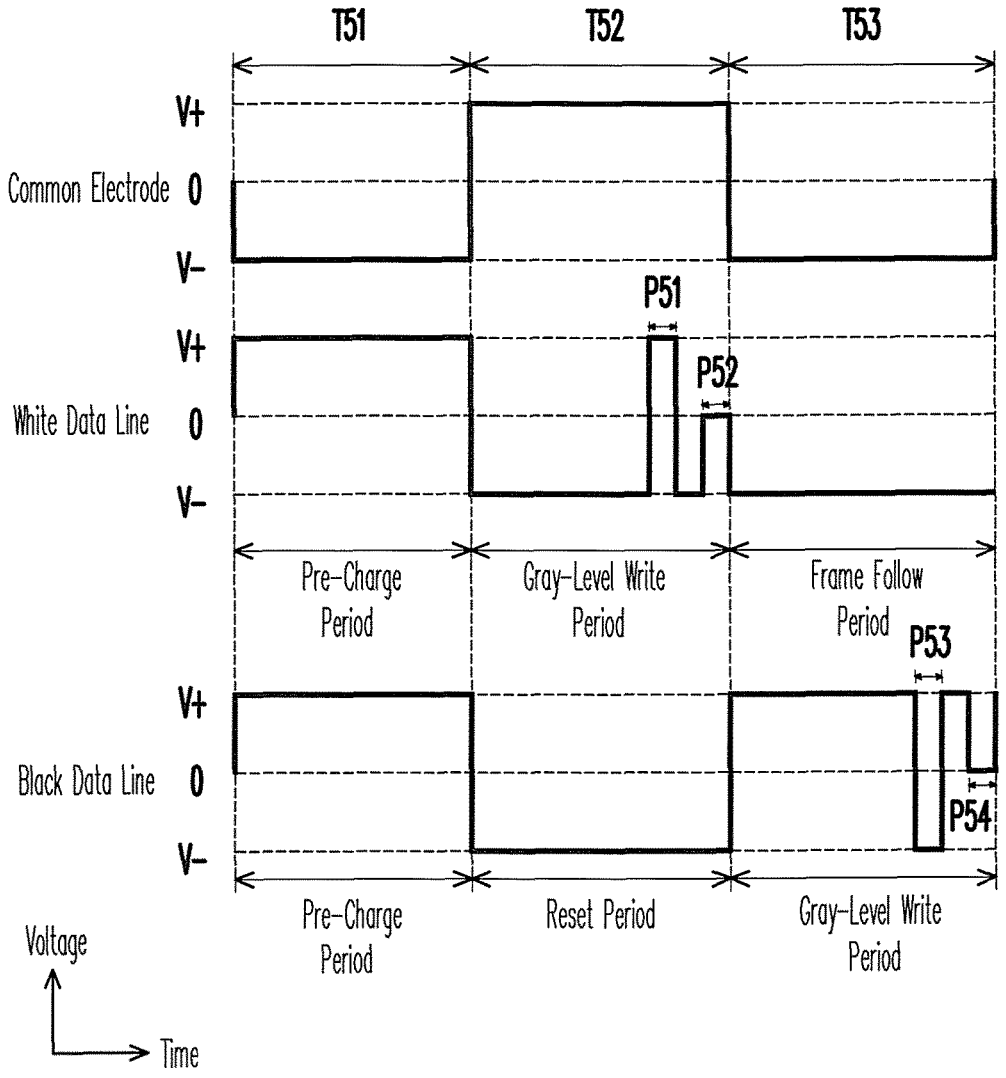
FIG. 4 is a schematic view illustrating a driving waveform of an electrophoretic display in accordance with a fourth embodiment of the invention.

FIG. 4 is a schematic view illustrating a driving waveform of an electrophoretic display in accordance with a fourth embodiment of the invention. Referring to FIG. 1A and FIG. 4, a difference resides in that the voltages applied in the corresponding periods are opposite. In addition, the periods T51, T52, and T53 are respectively, a pre-charge period of the white display particles, a gray-level write period of the black image, and a frame follow period of the black image. Moreover, the periods T51, T52, and T53 are respectively, a pre-charge period of the white display particles, a reset period of the white image, and a gray-level write period of the white image. Since a description of the particle restore periods P51 and P52 can be inferred from the description of the particle restore periods P23 and P24, and a description of the particle restore periods P53 and P54 can be inferred from the description of the particle restore periods P21 and P22, these descriptions are omitted hereafter.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

Fifth Embodiment

Figure 5:
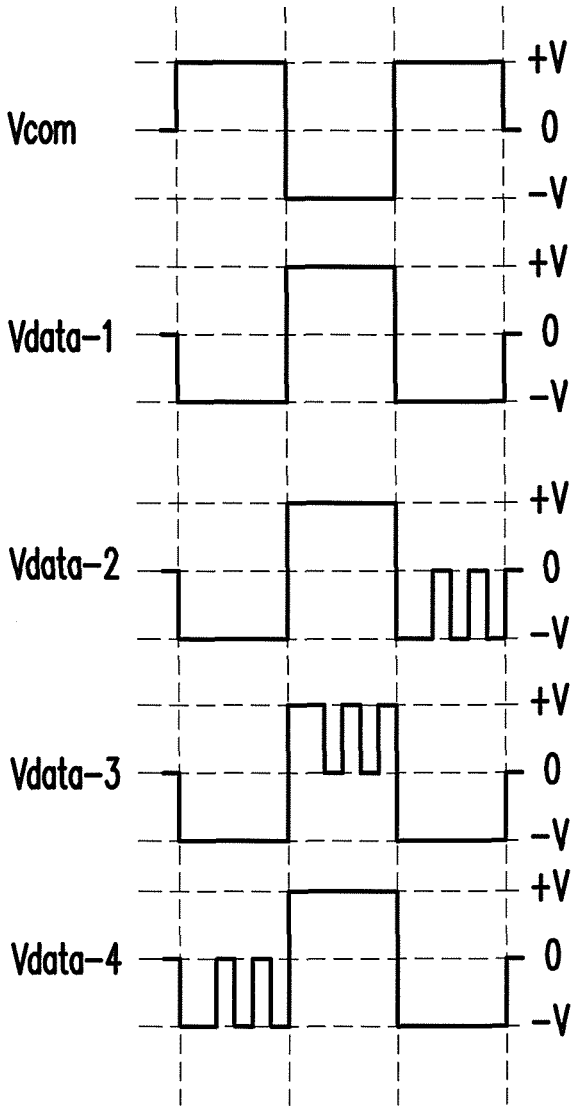
FIG. 5 is a schematic view illustrating a driving waveform of an electrophoretic display in accordance with a fifth embodiment of the invention.

FIG. 5 is a schematic view illustrating a driving waveform of an electrophoretic display in accordance with a fifth embodiment of the invention. When the voltage of common electrode is AC (Vcom shown in FIG. 5), a ordinary driving scheme would be the trace of data-1, which would result in the bad optical bouncing as indicated in the curve 210 of FIG. 1B. However, if we insert several periods of OV (i.e. particle restore periods) in the data line (as shown in the traces of data-2, data-3, data-4, or their different combinations in FIG. 5), this would result in better optical performance as indicated in the curve 220 of FIG. 1B. In case that the voltage of common electrode is DC, this method also applicable as long as the voltage difference between the data line and common electrodes would adopt several periods of 0V. The period of 0V is around 1 millisecond to 800 millisecond, preferably 5 millisecond to 300 millisecond, most preferably 10 millisecond to 200 millisecond.

Sixth Embodiment

The embodiment described in the fifth embodiment contains only three phases. The function of the phases can be used to reset the previous image, increase the gray level accuracy, increase the bistability, enhance the contrast ratio, and improve other image performances. The more the phases, the more the flexibility to improve the image performances. Thus, the design philosophy of fifth embodiment can be extended by adopting more phases to get better image performances or less phases to save the image transaction time. Besides, based on the common sense of waveform design, the voltage on common electrode can be either alterative (AC) or constant (DC).

What is claimed is:

1. A driving method of an electrophoretic display, the electrophoretic display having at least one display particle, the driving method comprising:

applying a first voltage difference including a first polarity to a white data line in a first period, wherein the white data line corresponds to one of the display particles, and applying the first voltage difference including a second polarity to a black data line in a second period, wherein the black data line corresponds to another one of the display particles, wherein the first polarity of the first voltage difference applied to the white data line in the first period is opposite to the second polarity of the first voltage difference applied to the black data line in the second period, and the first period is different from the second period in timing;

inserting at least one particle restore period in the first period only for the white data line, inserting the at least one particle restore period in the second period only for the black data line, and respectively applying a second voltage difference including a third polarity to the white data line in the at least one particle restore period of the first period or respectively applying a second voltage difference including a fourth polarity to the black data line in at least one the particle restore period of the second period, wherein the third polarity of the second voltage difference applied to the white data line in the at least one particle restore period of the first period is opposite to the fourth polarity of the second voltage difference applied to the black data line in the at least one particle restore period of the second period, wherein the second voltage difference is different from the first voltage difference, the second voltage difference is applied to the white data line only during the first period and applied to the black data line only during the second period, and when more than one particle restore periods are inserted, the particle restore periods are not adjacent to each other.

2. The driving method of the electrophoretic display as claimed in claim 1, wherein the first period is a pre-charge period, a gray-level write period, a reset period, or a frame follow period.

3. The driving method of the electrophoretic display as claimed in claim 1, wherein the first voltage difference and the second voltage difference are formed between the white data line or the black data line and a common electrode of the electrophoretic display.

4. The driving method of the electrophoretic display as claimed in claim 1, wherein when more than one particle restore periods are inserted, the second voltage differences respectively applied to the white data line or the black data line in the particle restore periods are different from each other.

5. The driving method of the electrophoretic display as claimed in claim 1, wherein when more than one particle restore periods are inserted, the cycles of the particle restore periods inserted in the first period and the second period are the same.

* * * * *